US008152869B2

(12) United States Patent
Hayes et al.

(10) Patent No.: US 8,152,869 B2
(45) **Date of Patent: *Apr. 10, 2012**

(54) FUEL COMPOSITIONS

(75) Inventors: Howard Richard Hayes, Chester (GB); David John Wedlock, Chester (GB)

(73) Assignee: Shell Oil Company, Houston, TX (US)

( * ) Notice: Subject to any disclaimer, the term of this patent is extended or adjusted under 35 U.S.C. 154(b) by 421 days.

This patent is subject to a terminal disclaimer.

(21) Appl. No.: 12/337,414

(22) Filed: Dec. 17, 2008

(65) Prior Publication Data

US 2009/0158641 A1 Jun. 25, 2009

(30) Foreign Application Priority Data

Dec. 20, 2007 (EP) ..... 07291616

(51) Int. Cl.
*C10L 1/18* (2006.01)

(52) U.S. Cl. ..... 44/309; 44/308

(58) Field of Classification Search ..... 44/308, 44/309; 508/110; 208/19
See application file for complete search history.

(56) References Cited

U.S. PATENT DOCUMENTS

| | | | | |
|---|---|---|---|---|
| 4,208,190 | A | 6/1980 | Malec | 44/53 |
| 4,343,692 | A | 8/1982 | Winquist | 208/111 |
| 4,574,043 | A | 3/1986 | Chester et al. | 208/59 |
| 4,795,546 | A | 1/1989 | Miller | 208/97 |
| 4,827,064 | A | 5/1989 | Wu | 585/10 |
| 4,859,311 | A | 8/1989 | Miller | 208/89 |
| 4,943,672 | A | 7/1990 | Hamner et al. | 585/737 |
| 5,053,373 | A | 10/1991 | Zones | 502/64 |
| 5,059,299 | A | 10/1991 | Cody et al. | 208/27 |
| 5,157,191 | A | 10/1992 | Bowes et al. | 585/533 |
| 5,252,527 | A | 10/1993 | Zones | 502/64 |
| 5,490,864 | A | 2/1996 | Herbstman et al. | 44/379 |
| 6,165,949 | A | 12/2000 | Berlowitz et al. | 508/363 |
| 6,663,767 | B1 | 12/2003 | Berlowitz et al. | 208/15 |
| 7,053,254 | B2 | 5/2006 | Miller | 585/1 |
| 2002/0062053 | A1 | 5/2002 | Berlowitz et al. | 585/14 |
| 2004/0045868 | A1 | 3/2004 | Germaine | 208/58 |
| 2004/0065581 | A1 | 4/2004 | Jiang et al. | 208/18 |
| 2005/0098476 | A1 | 5/2005 | Miller | 208/19 |
| 2005/0210739 | A1 | 9/2005 | Esen et al. | 44/605 |
| 2006/0196109 | A1 * | 9/2006 | Morton et al. | 44/393 |
| 2006/0201851 | A1 * | 9/2006 | Rosenbaum et al. | 208/18 |
| 2006/0219597 | A1 | 10/2006 | Bishop et al. | 208/15 |
| 2007/0100177 | A1 | 5/2007 | Clark et al. | 585/14 |

FOREIGN PATENT DOCUMENTS

| | | |
|---|---|---|
| AU | 698391 | 10/1998 |
| CA | 2242517 | 1/1999 |
| EP | 0147240 | 7/1985 |
| EP | 0482253 | 4/1992 |
| EP | 0532118 | 3/1993 |
| EP | 0613938 | 9/1994 |
| EP | 0668342 | 8/1995 |
| EP | 0776959 | 6/1997 |
| EP | 0712922 | 2/2000 |
| EP | 0666894 | 11/2000 |
| EP | 0583836 | 2/2002 |
| EP | 1382639 | 1/2004 |
| EP | 1548088 | 6/2005 |
| EP | 1534801 | 1/2006 |
| EP | 1645615 | 4/2006 |
| EP | 1516038 | 8/2006 |
| EP | 1686164 | 8/2006 |
| GB | 960493 | 6/1964 |
| GB | 2433072 | 6/2007 |
| WO | WO9306194 | 4/1993 |
| WO | WO9718278 | 5/1994 |
| WO | WO9417160 | 8/1994 |
| WO | WO9533805 | 12/1995 |
| WO | WO9641849 | 12/1996 |
| WO | WO9801516 | 1/1998 |
| WO | WO9842808 | 10/1998 |
| WO | WO9920720 | 4/1999 |
| WO | WO9934917 | 7/1999 |
| WO | WO0014179 | 3/2000 |
| WO | WO0014184 | 3/2000 |
| WO | WO0029511 | 5/2000 |
| WO | WO02064710 | 8/2002 |
| WO | WO02070627 | 9/2002 |
| WO | WO03004588 | 1/2003 |
| WO | WO03070857 | 8/2003 |
| WO | WO2004000975 | 12/2003 |
| WO | WO2004003113 | 1/2004 |
| WO | WO2004033607 | 4/2004 |
| WO | WO2005054411 | 6/2005 |
| WO | WO2005063941 | 7/2005 |
| WO | WO2006003119 | 1/2006 |
| WO | WO2006040319 | 4/2006 |
| WO | WO2006122978 | 11/2006 |
| WO | WO2007028947 | 3/2007 |
| WO | WO2007065512 | 6/2007 |
| WO | WO2008135602 | 11/2008 |
| WO | WO2009068539 | 6/2009 |

(Continued)

OTHER PUBLICATIONS

Danping Wei and H. A. Spikes, "The Lubricity of Diesel Fuels," *Wear*, III (1986) pp. 217-235.

(Continued)

*Primary Examiner* — Walter D Griffin
*Assistant Examiner* — Francis C Campanell

(57) ABSTRACT

Middle distillate fuel composition is provided containing (a) a middle distillate base fuel, in particular a diesel base fuel, and (b) a Fischer-Tropsch derived paraffinic base oil component with a viscosity of at least 8 $mm^2/s$ at 100° C. In component (b), the ratio of the percentage of epsilon methylene carbon atoms to the percentage of isopropyl carbon atoms is suitably 8.2 or below. Its pour point may be −30° C. or lower. Also disclosed is the use of a Fischer-Tropsch derived paraffinic heavy base oil in a middle distillate fuel composition, for the purpose of improving the cold flow properties of the composition and/or for reducing the concentration of a cold flow or flow improver additive in the composition.

11 Claims, No Drawings

OTHER PUBLICATIONS

M. J. Van der Burgt et al., "The Shell Middle Distillate Synthesis Process," paper delivered at the 5th Synfuels Worldwide Symposium, Washington DC, Nov. 1985.

M. J. Van der Burgt et al., "The Shell Middle Distillate Synthesis Process," updated from a paper delivered at the 5th Synfuels Worldwide Symposium, Washington DC, Nov. 1985, published by Shell International Petroleum Company Ltd, Shell Centre, London SE1 7NA, England (1989).

European Search Report for related Application No. 07291617.4-2104 of Jun. 4, 2008.

* cited by examiner

FUEL COMPOSITIONS

This application claims the benefit of European Application No. 07291616.6 filed Dec. 20, 2007.

FIELD OF THE INVENTION

The present invention relates to middle distillate fuel compositions and to their preparation and uses.

BACKGROUND OF THE INVENTION

The Fischer-Tropsch condensation process is a reaction which converts carbon monoxide and hydrogen into longer chain, usually paraffinic, hydrocarbons:

$$n(CO+2H_2)=(—CH_2—)_n+nH_2O+\text{heat},$$

in the presence of an appropriate catalyst and typically at elevated temperatures (e.g. 125 to 300° C., preferably 175 to 250° C.) and/or pressures (e.g. 5 to 100 bar, preferably 12 to 50 bar). Hydrogen:carbon monoxide ratios other than 2:1 may be employed if desired.

The carbon monoxide and hydrogen may themselves be derived from organic or inorganic, natural or synthetic sources, typically either from natural gas or from organically derived methane. In general, the gases which are converted into liquid fuel components using Fischer-Tropsch processes can include natural gas (methane), LPG (e.g. propane or butane), "condensates" such as ethane, synthesis gas (carbon monoxide/hydrogen) and gaseous products derived from coal, biomass and other hydrocarbons.

The Fischer-Tropsch process can be used to prepare a range of hydrocarbon fuels, including LPG, naphtha, kerosene and gas oil fractions. Of these, the gas oils have been used as, and in, automotive diesel fuel compositions, typically in blends with petroleum derived gas oils. The heavier fractions can yield, following hydroprocessing and vacuum distillation, a series of base oils having different distillation properties and viscosities, which are useful as lubricating base oil stocks. The higher molecular weight, so-called "bottoms" product that remains after recovering the lubricating base oil cuts from the vacuum column is usually recycled to a hydrocracking unit for conversion into lower molecular weight products, often being considered unsuitable for use as a lubricating base oil itself.

Such bottoms products have also been proposed for use as additives in distillate base oils, as in U.S. Pat. No. 7,053,254, where a Fischer-Tropsch bottoms-derived additive is used to improve the lubricating properties of a distillate base oil and in particular to reduce its pour point.

The higher boiling, heavier bottoms product tends to have a relatively high wax content. It would typically be regarded, therefore, as unsuitable for inclusion in an automotive diesel fuel, because of its likely detrimental effect on cold flow properties, in particular the cold filter plugging point (CFPP). It would also be expected to raise the cloud point of the fuel.

SUMMARY OF THE INVENTION

A middle distillate fuel composition is provided comprising (a) a middle distillate base fuel and (b) a Fischer-Tropsch derived paraffinic base oil component with a viscosity of at least 8 $mm^2/s$ at 100° C. A method for formulating a middle distillate fuel is provided comprising (i) measuring the cold flow properties of the base fuel and (ii) incorporating into the base fuel a Fischer-Tropsch derived paraffinic heavy base oil, in an amount effective to improve the cold flow properties of the mixture. A method of operating a fuel system using such fuel composition is also provided.

DETAILED DESCRIPTION OF THE INVENTION

It has now been found, that an appropriately processed Fischer-Tropsch bottoms-derived base oil (hereinafter referred to as a "Fischer-Tropsch derived heavy base oil") can actually improve the cold flow properties, in particular the cold filter plugging point, of a middle distillate fuel composition.

According to one aspect of the present invention there is therefore provided a middle distillate fuel composition comprising (a) a middle distillate base fuel—in particular a diesel base fuel—and (b) a Fischer-Tropsch derived paraffinic base oil component with a viscosity of at least 8 $mm^2/s$ at 100° C.

It has been found that the inclusion of a Fischer-Tropsch derived paraffinic heavy base oil in a middle distillate fuel composition, in accordance with the present invention, can lead to an improvement in the cold flow properties of the composition, in particular a reduction in its cold filter plugging point (CFPP). This apparent synergy between the middle distillate base fuel—typically a petroleum derived base fuel—and the heavy base oil is particularly surprising since a heavy base oil derived from a Fischer-Tropsch bottoms product is, as described above, high in wax content and also tends to have a relatively high cloud point; it might, therefore, be expected to increase the CFPP of a fuel composition to which it is added.

The effect is particularly surprising since it has not been observed when lighter, lower viscosity, low pour point Fischer-Tropsch derived base oils are incorporated into middle distillate fuel compositions, as demonstrated in Example 2 below.

U.S. Pat. No. 7,053,254, as described above, proposed the blending of Fischer-Tropsch bottoms-derived base oils with lighter base oils, in order to improve the lubricating properties of the blend, in particular by depressing its pour point. It cannot, however, be predicted from such teachings that a Fischer-Tropsch derived heavy base oil would be suitable, much less advantageous, for inclusion in a middle distillate fuel composition, in particular a diesel fuel composition such as an automotive diesel fuel composition. Moreover, the bottoms-derived base oils preferred in U.S. Pat. No. 7,053,254 are different to those preferred for use in the present invention, as will become apparent from the description below, indicating that the invention disclosed in the earlier document is likely to be based on different technical effects to those underlying the present invention.

In the context of the present invention, a Fischer-Tropsch derived paraffinic heavy base oil is suitably a base oil which has been derived, whether directly or indirectly following one or more downstream processing steps, from a Fischer-Tropsch "bottoms" (i.e. high boiling) product. A Fischer-Tropsch bottoms product is a hydrocarbon product recovered from the bottom of a fractionation column, usually a vacuum column, following fractionation of a Fischer-Tropsch derived feed stream.

In more general terms, the term "Fischer-Tropsch derived" means that a material is, or derives from, a synthesis product of a Fischer-Tropsch condensation process. The term "non-Fischer-Tropsch derived" may be interpreted accordingly. A Fischer-Tropsch derived fuel or fuel component will, therefore, be a hydrocarbon stream in which a substantial portion, except for added hydrogen, is derived directly or indirectly from a Fischer-Tropsch condensation process.

A Fischer-Tropsch derived product may also be referred to as a GTL product.

Hydrocarbon products may be obtained directly from the Fischer-Tropsch reaction, or indirectly, for instance by fractionation of Fischer-Tropsch synthesis products or from hydrotreated Fischer-Tropsch synthesis products. Hydrotreatment can involve hydrocracking to adjust the boiling range and/or hydroisomerisation which can improve cold flow properties by increasing the proportion of branched paraffins. Other post-synthesis treatments, such as polymerisation, alkylation, distillation, cracking-decarboxylation, isomerisation and hydroreforming, may be employed to modify the properties of Fischer-Tropsch condensation products.

Typical catalysts for the Fischer-Tropsch synthesis of paraffinic hydrocarbons comprise, as the catalytically active component, a metal from Group VIII of the periodic table, in particular ruthenium, iron, cobalt or nickel. Suitable such catalysts are described for instance in EP-A-0583836 (pages 3 and 4).

An example of a Fischer-Tropsch based process is the SMDS (Shell Middle Distillate Synthesis) described in "The Shell Middle Distillate Synthesis Process", van der Burgt et al, paper delivered at the 5th Synfuels Worldwide Symposium, Washington D.C., November 1985 (see also the November 1989 publication of the same title from Shell International Petroleum Company Ltd, London, UK). This process (also sometimes referred to as the Shell "Gas-To-Liquids" or "GTL" technology) produces middle distillate range products by conversion of a natural gas (primarily methane) derived synthesis gas into a heavy long chain hydrocarbon (paraffin) wax which can then be hydroconverted and fractionated to produce liquid transport fuels such as the gas oils useable in diesel fuel compositions. Base oils, including heavy base oils, may also be produced by such a process. A version of the SMDS process, utilising a fixed bed reactor for the catalytic conversion step, is currently in use in Bintulu, Malaysia, and its gas oil products have been blended with petroleum derived gas oils in commercially available automotive fuels.

By virtue of the Fischer-Tropsch process, a Fischer-Tropsch derived fuel or fuel component has essentially no, or undetectable levels of, sulphur and nitrogen. Compounds containing these heteroatoms tend to act as poisons for Fischer-Tropsch catalysts and are, therefore, removed from the synthesis gas feed. This can bring additional benefits to fuel compositions in accordance with the present invention.

Further, the Fischer-Tropsch process as usually operated produces no or virtually no aromatic components. The aromatics content of a Fischer-Tropsch derived fuel component, suitably determined by ASTM D-4629, will typically be below 1 wt %, preferably below 0.5 wt % and more preferably below 0.1 wt % on a molecular (as opposed to atomic) basis.

Generally speaking, Fischer-Tropsch derived hydrocarbon products have relatively low levels of polar components, in particular polar surfactants, for instance compared to petroleum derived fuels. This may contribute to improved anti-foaming and dehazing performance. Such polar components may include, for example, oxygenates, and sulphur and nitrogen containing compounds. A low level of sulphur in a Fischer-Tropsch derived fuel is generally indicative of low levels of both oxygenates and nitrogen containing compounds, since all are removed by the same treatment processes.

Fischer-Tropsch derived materials can, therefore, be extremely advantageous for use in automotive fuel compositions, resulting, for example, in reduced emissions during use. They also typically have higher cetane numbers, and higher calorific values, than their petroleum derived counterparts. The relatively high viscosity and inherent lubricity of Fischer-Tropsch derived heavy base oils can also improve the properties and performance of fuel compositions, in particular providing additional upper ring pack lubrication and enhanced fuel economy. Thus, the inclusion of such components in a diesel fuel composition according to the present invention can have a number of benefits, not only in terms of their effect on cold flow properties.

The Fischer-Tropsch derived paraffinic heavy base oil component (b) used in a fuel composition according to the present invention is a heavy hydrocarbon product comprising at least 95 wt % paraffin molecules. Preferably, the heavy base oil component (b) is prepared from a Fischer-Tropsch wax and comprises more than 98 wt % of saturated, paraffinic hydrocarbons. Preferably at least 85 wt %, more preferably at least 90 wt %, yet more preferably at least 95 wt %, and most preferably at least 98 wt % of these paraffinic hydrocarbon molecules are isoparaffinic. Preferably, at least 85 wt % of the saturated, paraffinic hydrocarbons are non-cyclic hydrocarbons. Naphthenic compounds (paraffinic cyclic hydrocarbons) are preferably present in an amount of no more than 15 wt %, more preferably less than 10 wt %.

The Fischer-Tropsch derived paraffinic heavy base oil component (b) suitably contains hydrocarbon molecules having consecutive numbers of carbon atoms, such that it comprises a continuous series of consecutive iso-paraffins, i.e. iso-paraffins having n, n+1, n+2, n+3 and n+4 carbon atoms. This series is a consequence of the Fischer-Tropsch hydrocarbon synthesis reaction from which the heavy base oil derives, following isomerisation of the wax feed.

Component (b) is typically a liquid at the temperature and pressure conditions of use and typically, although not always, under ambient conditions, i.e. at 25° C. and one atmosphere (101 kPa) pressure.

The kinematic viscosity at 100° C. (VK100) of component (b), as measured according to ASTM D-445, should be at least 8 $mm^2/s$ (cSt). Preferably, its VK100 is at least 10 $mm^2/s$ (cSt), more preferably at least 13 cSt, yet more preferably at least 15 $mm^2/s$ (cSt), again more preferably at least 17 $mm^2/s$ (cSt), and yet again more preferably at least 20 $mm^2/s$ (cSt). Kinematic viscosities described in this specification were determined according to ASTM D-445, whilst viscosity indices (VI) were determined using ASTM D-2270.

The boiling range distribution of samples having a boiling range above 535° C. was measured according to ASTM D-6352, while for lower boiling materials, the boiling range distributions were measured according to ASTM D-2887.

Component (b) preferably has an initial boiling point of at least 400° C. More preferably, its initial boiling point is at least 450° C., yet more preferably at least 480° C.

The initial and end boiling point values referred to herein are nominal and refer to the T5 and T95 cut-points (boiling temperatures) obtained by gas chromatograph simulated distillation (GCD).

Since conventional petroleum derived hydrocarbons and Fischer-Tropsch derived hydrocarbons comprise a mixture of varying molecular weight components having a wide boiling range, this disclosure will refer to the 10 wt % recovery point and the 90 wt % recovery point of the respective boiling ranges. The 10 wt % recovery point refers to that temperature at which 10 wt % of the hydrocarbons present within that cut will vaporise at atmospheric pressure, and could thus be recovered. Similarly, the 90 wt % recovery point refers to the temperature at which 90 wt % of the hydrocarbons present will vaporise at atmospheric pressure. When referring to a boiling range distribution, the boiling range between the 10 wt % and 90 wt % recovery boiling points is referred to in this specification. Molecular weights referred to in this specification were determined according to ASTM D-2503.

Component (b) according to the present invention preferably contains molecules having consecutive numbers of carbon atoms and preferably at least 95 wt % C30+ hydrocarbon molecules. More preferably, component (b) contains at least 75 wt % of C35+ hydrocarbon molecules.

"Cloud point" refers to the temperature at which a sample begins to develop a haze, as determined according to ASTM D-5773. Component (b) typically has a cloud point between +49° C. and −60° C. Preferably, component (b) has a cloud point between +30° C. and −55° C., more preferably between +10° C. and −50° C. It has been found that depending on the feed and the dewaxing conditions, some of the Fischer-Tropsch derived paraffinic heavy base oil component (b) could have a cloud point above ambient temperature, while other properties are not negatively affected.

Component (b) preferably has a viscosity index of between 120 and 160. It will preferably contain no or very little sulphur and nitrogen containing compounds. As described above, this is typical for a product derived from a Fischer-Tropsch reaction, which uses synthesis gas containing almost no impurities.

Preferably, component (b) comprises sulphur, nitrogen and metals in the form of hydrocarbon compounds containing them, in amounts of less than 50 ppmw (parts per million by weight), more preferably less than 20 ppmw, yet more preferably less than 10 ppmw. Most preferably, it will comprise sulphur and nitrogen at levels generally below the detection limits, which are currently 5 ppmw for sulphur and 1 ppmw for nitrogen, when using, for instance, X-ray or 'Antek' Nitrogen tests for determination. However, sulphur may be introduced through the use of sulphided hydrocracking/hydrodewaxing and/or sulphided catalytic dewaxing catalysts.

The Fischer-Tropsch derived paraffinic heavy base oil component (b) used in the present invention is preferably separated as a residual fraction from the hydrocarbons produced during a Fischer-Tropsch synthesis reaction and subsequent hydrocracking and dewaxing steps.

More preferably, this fraction is a distillation residue comprising the highest molecular weight compounds still present in the product of the hydroisomerisation step. The 10 wt % recovery boiling point of said fraction is preferably above 370° C., more preferably above 400° C. and most preferably above 500° C. for certain embodiments of the present invention.

Component (b) can further be characterised by its content of different carbon species. More particularly, component (b) can be characterised by the percentage of its epsilon methylene carbon atoms, i.e. the percentage of recurring methylene carbons which are four or more carbons removed from the nearest end group and also from the nearest branch (further referred to as CH2>4) as compared to the percentage of its isopropyl carbon atoms. In the following text, the ratio of the percentage of epsilon methylene carbon atoms to the percentage of isopropyl carbon atoms (i.e. carbon atoms in isopropyl branches), as measured for the base oil as a whole, is referred to as the epsilon:isopropyl ratio.

It has been found that isomerised Fischer-Tropsch bottoms products as disclosed in U.S. Pat. No. 7,053,254 differ from Fischer-Tropsch derived paraffinic base oil components obtained at a higher dewaxing severity, in that the latter compounds have an epsilon:isopropyl ratio of 8.2 or below. It has been found that a measurable pour point depressing effect through base stock blending, as disclosed in U.S. Pat. No. 7,053,254, can only be achieved if in the base oil, the epsilon:isopropyl ratio is 8.2 or above. It is noted that where no pour point reducing effect in a base stock is desired, the addition of a Fischer-Tropsch derived heavy base oil component (b) having a lower pour point and a higher content of compounds having an epsilon:isopropyl ratio of 8.2 or below may be beneficial, since such blends tend to be more homogeneous, as expressed by their lower cloud points.

It has also been found that there appears to be a correlation between the kinematic viscosity, the pour point and the pour point depressing effect of an isomerised Fischer-Tropsch derived bottoms product. At a given feed composition and boiling range (as defined by the lower cut point from the distillate base oil and gas oil fractions after dewaxing) for the bottoms product, the pour point and the obtainable viscosity are linked to the severity of the dewaxing treatment. It has been found that a pour point depressing effect is noticeable for isomerised Fischer-Tropsch derived bottoms products having a pour point of above −28° C., an average molecular weight between about 600 and about 1100 and an average degree of branching in the molecules of between about 6.5 and about 10 alkyl branches per 100 carbon atoms, as disclosed in U.S. Pat. No. 7,053,254.

The Fischer-Tropsch derived heavy base oil component (b) used in a composition according to the present invention may, however, have a pour point of below +6° C., or in cases even lower, and has suitably been subjected to relatively severe dewaxing. It further preferably has an average degree of branching in the molecules of above 10 alkyl branches per 100 carbon atoms, as determined in line with the method disclosed in U.S. Pat. No. 7,053,254. Such a component tends to have no or only a negligible pour point depressing effect, such that the pour points of blends comprising components (a) and (b) lie between the pour points of the two components.

"Pour point" refers to the temperature at which a base oil sample will begin to flow under carefully controlled conditions. The pour points referred to herein were determined according to ASTM D-97-93.

In cases the heavy base oil component (b) used in the present invention may have a pour point of −8° C. or lower, preferably of −10 or −15 or −20 or −25 or −28 or even −30 or −35 or −40 or −45° C. or lower. It may thus be a base oil of the type which has been subjected to relatively severe (i.e. high temperature catalytic) dewaxing, such as can result in a pour point of −30° C. or below, for example from −30 to −45° C., as opposed to the type which has been subjected to relatively mild dewaxing to result in a pour point of around −6° C. The latter type is known for use as a pour point depressant, whereas the former is not generally used for this purpose, making the results obtained according to the present invention even more surprising.

The branching properties as well as the carbon composition of a Fischer-Tropsch derived base oil blending component can conveniently be determined by analysing a sample of the oil using $^{13}$C-NMR, vapour pressure osmometry (VPO) and field ionisation mass spectrometry (FIMS), as follows. The number average molecular mass can be obtained via vapour pressure osmometry (VPO). Samples can be characterised at the molecular level by means of nuclear magnetic resonance (NMR) spectroscopy.

Conventional NMR spectra can have the problem of signal overlap due to the presence of a great number of isomers in a base oil composition. To overcome this problem, selected multiplet subspectral carbon-13 nuclear magnetic resonance ($^{13}$C-NMR) analyses can be applied. In particular, gated spin echo (GASPE) can be applied to obtain quantitative $CH_n$ subspectra. The quantitative data obtained from GASPE can have a better accuracy than those from distortionless enhancement by polarisation transfer (DEPT, as for instance applied in the process disclosed in U.S. Pat. No. 7,053,254).

On the basis of the GASPE data and of the average molecular mass obtained via VPO, the average number of branches and aliphatic rings can be calculated. Further, on the basis of GASPE, the distribution of side chain lengths and the positions of the methyl groups along the straight chains can be obtained.

Quantitative carbon multiplicity analysis is normally carried out entirely at room temperature. However this is only applicable to materials which are liquid under these conditions. This method is applicable to any Fischer-Tropsch derived or base oil material which is hazy or a waxy solid at room temperature and which cannot, therefore, be analysed by the normal method. A suitable methodology for the NMR measurements is as follows: deuterated chloroform ($CDCl_3$) is employed as the solvent for determination of quantitative carbon multiplicity analysis, limiting the maximum measurement temperature to 50° C. for practical reasons. A base oil sample is heated in an oven at 50° C. until it forms a clear and liquid homogeneous product. A portion of the sample is then transferred into an NMR tube. Preferably, the NMR tube and any apparatus used in the transfer of the sample are kept at this temperature. The above-identified solvent is then added and the tube shaken to dissolve the sample, optionally involving reheating of the sample. To prevent solidification of any high melting material in the sample, the NMR instrument is maintained at 50° C. during acquisition of the data. The sample is placed in the NMR instrument for a minimum of 5 minutes, to allow the temperature to equilibrate. After this the instrument must be re-shimmed and re-tuned as both these adjustments will change considerably at the elevated temperature, and the NMR data can now be acquired.

A $CH_3$ subspectrum is obtained using the GASPE pulse sequence, by addition of a CSE spectrum (standard spin echo) to a 1/J GASPE (gated acquisition spin echo). The resultant spectrum contains primary ($CH_3$) and tertiary (CH) carbon peaks only.

Then the various carbon branch carbon resonances are assigned to specific positions and lengths applying tabulated data, and correcting for chain ends. The subspectrum is then integrated to give quantitative values for the different $CH_3$ signals, as follows.

1. $CH_3$-Carbon a. 25 ppm chemical shift (referenced against TMS).

b. 19 and 21 ppm can be identified as methyl branches of the following general type (see formula 1):

Formula 1

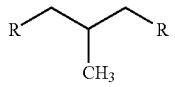

c. Distinct intense signals in the region of 22 to 24 ppm can be unambiguously identified as isopropyl end groups of the following general structure (see Formula 2):

Formula 2

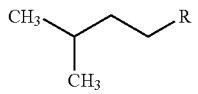

In this instance, one of the methyl carbon atoms is classified as a termination of the main chain, the other as a branch. Therefore, when calculating methyl branch content, the intensity of these signals is halved.

d. Further, several weak signals in the region of 15 to 19 ppm are considered to belong to an isopropyl group with an additional branch in the 3 position.

e. Observed in the spectrum are some weak signals in the region 8 to 8.5 ppm, most likely pertaining to 3,3-dimethyl substituted structures (Formula 3):

Formula 3

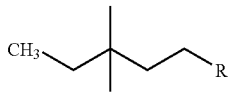

In this case the observed signal is for the terminal $CH_3$, but there are two corresponding methyl branches. Therefore the integral value of these signals is doubled (the signals for the two methyl branches are not counted independently).

The overall estimation of methyl branch content is thus based on the following calculation ("Int" representing the term "Integral", Formula 4):

$$\Sigma(\text{integrals methyls})=\text{Int 19 to 20 ppm}+(\text{Int 22 to 25 ppm})/2+\text{Int 15 to 19 ppm}+(\text{Int 7.0 to 9 ppm})*2 \quad \text{(Formula 4)}$$

2. The calculation of ethyl branch content is based on two distinct relatively intense signals observed at 11.5 and 10.9 ppm, assuming the isopentyl end group content to be negligible, based on the evidence from other peak assignments. Hence, the calculation of ethyl branch content is based solely on the integral of the signals at 10 to 11.2 ppm.

3. The overall theoretical terminal $CH_3$ content is calculated based on the "Z" content and the average carbon number, as determined by FIMS. The C3+ branch content is then determined by subtracting from the theoretical terminal $CH_3$ content the known terminal $CH_3$ contents i.e. half of the isopropyl value, the 3-methyl substituted value and the value for 3,3-dimethyl substituted structures, thereby resulting in a value for the signals in the 14 ppm region which belong to $CH_3$s terminating the chain, the difference being the value for the C3+ branches:

$$\Sigma(\text{integrals C3+branches})=\text{Int 14-15 ppm}-((\text{theoretical terminal } CH_3)-(\text{Int 11.2 to 11.8 ppm})-(\text{Int 22 to 25 ppm})/2-\text{Int 7 to 9 ppm})) \quad \text{(Formula 5).}$$

The density of the heavy base oil component (b) at 15° C., as measured by the standard test method IP 365/97, is suitably from about 700 to 1100 kg/m$^3$, preferably from about 834 to 841 kg/m$^3$.

In its broadest sense, the present invention embraces the use of a paraffinic heavy base oil component having one or more of the above described properties, whether or not the component is Fischer-Tropsch derived.

A fuel composition according to the present invention may contain a mixture of two or more Fischer-Tropsch derived paraffinic heavy base oil components.

In order to prepare a paraffinic heavy base oil for use in the present invention, a Fischer-Tropsch derived bottoms product is suitably subjected to an isomerisation process. This converts n- to iso-paraffins, thus increasing the degree of branching in the hydrocarbon molecules and improving cold flow properties. Depending on the catalysts and isomerisation conditions used, it can result in long chain hydrocarbon molecules having relatively highly branched end regions. Such molecules tend to exhibit relatively good cold flow performance.

The isomerised bottoms product may undergo further downstream processes, for example hydrocracking, hydrotreating and/or hydrofinishing. It is preferably subjected to a dewaxing step, either by solvent or more preferably by catalytic dewaxing, as described below, which serves further to reduce its pour point. However, even after dewaxing, a Fischer-Tropsch derived heavy base oil will still have a residual wax haze due to the extremely high molecular weight molecules which the dewaxing process cannot completely remove, and for this reason it is surprising that such oils can cause a reduction, as opposed to the expected increase, in CFPP when blended with middle distillate base fuels.

In general, a Fischer-Tropsch derived paraffinic heavy base oil for use in a composition according to the present invention may be prepared by any suitable Fischer-Tropsch process. Preferably, however, the paraffinic heavy base oil component (b) is a heavy bottom distillate fraction obtained from a Fischer-Tropsch derived wax or waxy raffinate feed by:

(a) hydrocracking/hydroisomerising a Fischer-Tropsch derived feed, wherein at least 20 wt % of compounds in the Fischer-Tropsch derived feed have at least 30 carbon atoms;
(b) separating the product of step (a) into one or more distillate fraction(s) and a residual heavy fraction comprising at least 10 wt % of compounds boiling above 540° C.;
(c) subjecting the residual fraction to a catalytic pour point reducing step; and
(d) isolating from the effluent of step (c), as a residual heavy fraction, the Fischer-Tropsch derived paraffinic heavy base oil component.

In addition to isomerisation and fractionation, the Fischer-Tropsch derived product fractions may undergo various other operations, such as hydrocracking, hydrotreating and/or hydrofinishing.

The feed from step (a) is a Fischer-Tropsch derived product. The initial boiling point of the Fischer-Tropsch product may be up to 400° C., but is preferably below 200° C. Preferably, any compounds having 4 or fewer carbon atoms and any compounds having a boiling point in that range are separated from a Fischer-Tropsch synthesis product before the Fischer-Tropsch synthesis product is used in said hydroisomerisation step. An example of a suitable Fischer-Tropsch process is described in WO-A-99/34917 and in AU-A-698391. The disclosed processes yield a Fischer-Tropsch product as described above.

The Fischer-Tropsch product can be obtained by well-known processes, for example the so-called Sasol process, the Shell Middle Distillate Synthesis process or the ExxonMobil "AGC-21" process. These and other processes are for example described in more detail in EP-A-0776959, EP-A-0668342, U.S. Pat. No. 4,943,672, U.S. Pat. No. 5,059,299, WO-A-99/34917 and WO-A-99/20720. The Fischer-Tropsch process will generally comprise a Fischer-Tropsch synthesis and a hydroisomerisation step, as described in these publications. The Fischer-Tropsch synthesis can be performed on synthesis gas prepared from any sort of hydrocarbonaceous material such as coal, natural gas or biological matter such as wood or hay.

The Fischer-Tropsch product directly obtained from a Fischer-Tropsch process contains a waxy fraction that is normally a solid at room temperature.

In case the feed to step (a) has a 10 wt % recovery boiling point of above 500° C. the wax content will suitably be greater than 50 wt %. The feed to the hydroisomerisation step (a) is preferably a Fischer-Tropsch product which has at least 30 wt %, preferably at least 50 wt %, and more preferably at least 55 wt % of compounds having at least 30 carbon atoms. Furthermore the weight ratio, in this feed, of compounds having at least 60 carbon atoms to those having at least 30 but fewer than 60 carbon atoms is preferably at least 0.2, more preferably at least 0.4 and most preferably at least 0.55. If the feed has a 10 wt % recovery boiling point of above 500° C., the wax content will suitably be greater than 50 wt %.

Preferably, the Fischer-Tropsch product comprises a C20+ fraction having an ASF-alpha value (Anderson-Schulz-Flory chain growth factor) of at least 0.925, preferably at least 0.935, more preferably at least 0.945, even more preferably at least 0.955.

The hydrocracking/hydroisomerisation reaction of step (a) is preferably performed in the presence of hydrogen and a catalyst, which catalyst can be chosen from those known to one skilled in the art as being suitable for this reaction. Catalysts for use in the hydroisomerisation typically comprise an acidic functionality and a hydrogenation-dehydrogenation functionality. Preferred acidic functionalities are refractory metal oxide carriers. Suitable carrier materials include silica, alumina, silica-alumina, zirconia, titania and mixtures thereof. Preferred carrier materials for inclusion in the catalyst are silica, alumina and silica-alumina. A particularly preferred catalyst comprises platinum supported on a silica-alumina carrier. Preferably, the catalyst does not contain a halogen compound, such as for example fluorine, because the use of such catalysts can require special operating conditions and can involve environmental problems. Examples of suitable hydrocracking/hydroisomerisation processes and catalysts are described in WO-A-00/14179, EP-A-0532118, EP-A-0666894 and the earlier referred to EP-A-0776959.

Preferred hydrogenation-dehydrogenation functionalities are Group VIII metals, for example cobalt, nickel, palladium and platinum, more preferably platinum. In the case of platinum and palladium, the catalyst may comprise the hydrogenation-dehydrogenation active component in an amount of from 0.005 to 5 parts by weight, preferably from 0.02 to 2 parts by weight, per 100 parts by weight of carrier material. In the case that nickel is used, a higher content will typically be present, and optionally the nickel is used in combination with copper. A particularly preferred catalyst for use in the hydroconversion stage comprises platinum in an amount in the range of from 0.05 to 2 parts by weight, more preferably from 0.1 to 1 parts by weight, per 100 parts by weight of carrier material. The catalyst may also comprise a binder to enhance the strength of the catalyst. The binder can be non-acidic. Examples are clays and other binders known to one skilled in the art.

In the hydroisomerisation the feed is contacted with hydrogen in the presence of the catalyst at elevated temperature and pressure. The temperatures typically will be in the range of from 175 to 380° C., preferably higher than 250° C. and more preferably from 300 to 370° C. The pressure will typically be in the range of from 10 to 250 bar and preferably from 20 to 80 bar. Hydrogen may be supplied at a gas hourly space velocity of from 100 to 10000 Nl/l/hr, preferably from 500 to 5000 Nl/l/hr. The hydrocarbon feed may be provided at a weight hourly space velocity of from 0.1 to 5 kg/l/hr, preferably higher than 0.5 kg/l/hr and more preferably lower than 2 kg/l/hr. The ratio of the hydrogen to the hydrocarbon feed may range from 100 to 5000 Nl/kg and is preferably from 250 to 2500 Nl/kg.

The conversion in the hydroisomerisation, defined as the weight percentage of the feed boiling above 370° C. which reacts per pass to a fraction boiling below 370° C., is suitably at least 20 wt %, preferably at least 25 wt %, but preferably not more than 80 wt %, more preferably not more than 70 wt %.

The feed as used above in the definition is the total hydrocarbon feed fed to the hydroisomerisation step, thus also any optional recycle to step (a).

The resulting product of the hydroisomerisation process preferably contains at least 50 wt % of iso-paraffins, more preferably at least 60 wt %, yet more preferably at least 70 wt %, the remainder being composed of n-paraffins and naphthenic compounds.

In step (b), the product of step (a) is separated into one or more distillate fraction(s) and a residual heavy fraction comprising at least 10 wt % of compounds boiling above 540° C. This is conveniently done by performing one or more distillate separations on the effluent of the hydroisomerisation step to obtain at least one middle distillate fuel fraction and a residual fraction which is to be used in step (c).

Preferably, the effluent from step (a) is first subjected to an atmospheric distillation. The residue as obtained in such a distillation may in certain preferred embodiments be subjected to a further distillation performed at near vacuum conditions to arrive at a fraction having a higher 10 wt % recovery boiling point. The 10 wt % recovery boiling point of the residue may preferably vary between 350 and 550° C. This atmospheric bottom product or residue preferably boils for at least 95 wt % above 370° C.

This fraction may be directly used in step (c) or may be subjected to an additional vacuum distillation suitably performed at a pressure of between 0.001 and 0.1 bar. The feed for step (c) is preferably obtained as the bottom product of such a vacuum distillation.

In step (c), the heavy residual fraction obtained in step (b) is subjected to a catalytic pour point reducing step. Step (c) may be performed using any hydroconversion process, which is capable of reducing the wax content to below 50 wt % of its original value. The wax content in the intermediate product is preferably below 35 wt % and more preferably between 5 and 35 wt %, and even more preferably between 10 and 35 wt %. The product as obtained in step (c) preferably has a congealing point of below 80° C. Preferably, more than 50 wt % and more preferably more than 70 wt % of the intermediate product boils above the 10 wt % recovery point of the wax feed used in step (a).

Wax contents may be measured according to the following procedure: 1 weight part of the oil fraction under analysis is diluted with 4 parts of a (50/50 vol/vol) mixture of methyl ethyl ketone and toluene, which is subsequently cooled to −20° C. in a refrigerator. The mixture is subsequently filtered at −20° C. The wax is thoroughly washed with cold solvent, removed from the filter, dried and weighed. Where reference is made to oil content, a wt % value is meant which is 100 wt % minus the wax content in wt %.

A possible process for step (c) is the hydroisomerisation process as described above for step (a). It has been found that wax levels may be reduced to the desired level using such catalysts. By varying the severity of the process conditions as described above, a skilled person will easily determine the required operating conditions to arrive at the desired wax conversion. However a temperature of between 300 and 330° C. and a weight hourly space velocity of between 0.1 and 5, more preferably between 0.1 and 3, kg of oil per litre of catalyst per hour (kg/l/hr) are especially preferred for optimising the oil yield.

A more preferred class of catalyst, which may be applied in step (c), is the class of dewaxing catalysts. The process conditions applied when using such catalysts should be such that a wax content remains in the oil. In contrast typical catalytic dewaxing processes aim at reducing the wax content to almost zero. Using a dewaxing catalyst comprising a molecular sieve will result in more of the heavy molecules being retained in the dewaxed oil. A more viscous base oil can then be obtained.

The dewaxing catalyst which may be applied in step (c) suitably comprises a molecular sieve, optionally in combination with a metal having a hydrogenation function, such as the Group VIII metals. Molecular sieves, and more suitably molecular sieves having a pore diameter of between 0.35 and 0.8 nm, have shown a good catalytic ability to reduce the wax content of the wax feed. Suitable zeolites are mordenite, beta, ZSM-5, ZSM-12, ZSM-22, ZSM-23, SSZ-32, ZSM-35, ZSM-48 and combinations of said zeolites, of which ZSM-12 and ZSM-48 are most preferred. Another preferred group of molecular sieves are the silica-aluminaphosphate (SAPO) materials of which SAPO-11 is most preferred as for example described in U.S. Pat. No. 4,859,311. ZSM-5 may optionally be used in its HZSM-5 form in the absence of any Group VIII metal. The other molecular sieves are preferably used in combination with an added Group VIII metal. Suitable Group VIII metals are nickel, cobalt, platinum and palladium. Examples of possible combinations are Pt/ZSM-35, Ni/ZSM-5, Pt/ZSM-23, Pd/ZSM-23, Pt/ZSM-48 and Pt/SAPO-11, or stacked configurations of Pt/zeolite beta and Pt/ZSM-23, Pt/zeolite beta and Pt/ZSM-48 or Pt/zeolite beta and Pt/ZSM-22. Further details and examples of suitable molecular sieves and dewaxing conditions are for example described in WO-A-97/18278, U.S. Pat. No. 4,343,692, U.S. Pat. No. 5,053,373, U.S. Pat. No. 5,252,527, US-A-2004/0065581, U.S. Pat. No. 4,574,043 and EP-A-1029029.

Another preferred class of molecular sieves comprises those having a relatively low isomerisation selectivity and a high wax conversion selectivity, like ZSM-5 and ferrierite (ZSM-35).

The dewaxing catalyst suitably also comprises a binder. The binder can be a synthetic or naturally occurring (inorganic) substance, for example clay, silica and/or a metal oxide. Natural occurring clays are for example of the montmorillonite and kaolin families. The binder is preferably a porous binder material, for example a refractory oxide of which examples include alumina, silica-alumina, silica-magnesia, silica-zirconia, silica-thoria, silica-beryllia and silica-titania as well as ternary compositions, for example silica-alumina-thoria, silica-alumina-zirconia, silica-alumina-magnesia and silica-magnesia-zirconia. More preferably, a low acidity refractory oxide binder material, which is essentially free of alumina, is used. Examples of these binder materials are silica, zirconia, titanium dioxide, germanium dioxide, boria and mixtures of two or more of these, of which examples are listed above. The most preferred binder is silica.

A preferred class of dewaxing catalysts comprises intermediate zeolite crystallites as described above and a low acidity refractory oxide binder material which is essentially free of alumina as described above, wherein the surface of the aluminosilicate zeolite crystallites has been modified by subjecting the aluminosilicate zeolite crystallites to a surface dealumination treatment. A preferred dealumination treatment involves contacting an extrudate of the binder and the zeolite with an aqueous solution of a fluorosilicate salt as described in for example U.S. Pat. No. 5,157,191 or WO-A-00/29511. Examples of suitable dewaxing catalysts as described above are silica bound and dealuminated Pt/ZSM-5, or silica bound and dealuminated Pt/ZSM-35 as for example described in WO-A-00/29511 and EP-B-0832171.

The conditions in step (c) when using a dewaxing catalyst typically involve operating temperatures in the range of from 200 to 500° C., suitably from 250 to 400° C. Preferably the temperature is between 300 and 330° C. The hydrogen pressures may range from 10 to 200 bar, preferably from 40 to 70 bar. Weight hourly space velocities (WHSV) may range from 0.1 to 10 kg of oil per litre of catalyst per hour (kg/l/hr), suitably from 0.1 to 5 kg/l/hr, more suitably from 0.1 to 3 kg/l/hr. Hydrogen to oil ratios may range from 100 to 2000 litres of hydrogen per litre of oil.

It has been found that when a dewaxing temperature of about 345° C. is exceeded in step (c), the yield and pour point drop exponentially until a further plateau is reached at a pour point in the range of from −50 to −60° C. It was further found that isomerised Fischer-Tropsch derived bottoms products having a pour point of below −28° C. showed a much reduced pour point depressing effect, or were no longer pour point depressing.

However, at the same time it has been found that higher amounts of isomerised Fischer-Tropsch derived bottoms products with such reduced pour points can be added to a middle distillate base fuel component (a) to achieve higher viscosities without increasing the cloud point to ambient temperature or above. On the other hand, when Fischer-Tropsch derived heavy base oils are used as additives to middle distillate fuels such as diesel base fuels, the cold filter pluggability of the resultant blends can be strongly reduced by both types of heavy base oil, those that act as pour point depressants and those that do not show a strong pour point reducing effect.

In step (d), the product of step (c) is usually sent to a vacuum column where the various distillate base oil cuts are collected. These distillate base oil fractions may be used to prepare lubricating base oil blends, or they may be cracked into lower boiling products, such as diesel or naphtha. The residual material collected from the vacuum column comprises a mixture of high boiling hydrocarbons, and can be used to prepare component (b) for use in the present invention.

Furthermore, the product obtained in step (c) may also be subjected to additional treatments, such as solvent dewaxing (for example to remove residual waxy haze). The product can be further treated, for example in a clay treating process or by contacting with active carbon, as for example described in U.S. Pat. No. 4,795,546 and EP-A-0712922, in order to remove unwanted components.

Other suitable processes for the production of heavy and extra heavy Fischer-Tropsch derived base oils are described in WO-A-2004/033607, U.S. Pat. No. 7,053,254, EP-A-1366134, EP-A-1382639, EP-A-1516038, EP-A-1534801, WO-A-2004/003113 and WO-A-2005/063941.

A middle distillate fuel composition according to the present invention may be for example a naphtha, kerosene or diesel fuel composition, typically either a kerosene or a diesel fuel composition. It may be an industrial gas oil, a drilling oil, an automotive diesel fuel, a distillate marine fuel or a kerosene fuel such as an aviation fuel or heating kerosene. It may in particular be a diesel fuel composition. Preferably, it is for use in an engine such as an automotive engine or an aeroplane engine. More preferably, it is suitable and/or adapted and/or intended for use in an internal combustion engine; yet more preferably, it is an automotive fuel composition, still more preferably, a diesel fuel composition which is suitable and/or adapted and/or intended for use in an automotive diesel (compression ignition) engine.

The fuel composition may in particular be adapted for, and/or intended for, use in colder climates and/or during colder seasons (for example, it may be a so-called "winter fuel").

The middle distillate base fuel which it contains may in general be any suitable liquid hydrocarbon middle distillate fuel oil. It may be organically or synthetically derived. It is suitably a diesel base fuel, for example a petroleum derived or Fischer-Tropsch derived gas oil (preferably the former).

A middle distillate base fuel will typically have boiling points within the usual middle distillate range of 125 or 150 to 400 or 550° C.

A diesel base fuel will typically have boiling points within the usual diesel range of 170 to 370° C., depending on grade and use. It will typically have a density from 0.75 to 1.0 g/cm$^3$, preferably from 0.8 to 0.86 g/cm$^3$, at 15° C. (IP 365) and a measured cetane number (ASTM D-613) of from 35 to 80, more preferably from 40 to 75 or 70. Its initial boiling point will suitably be in the range 150 to 230° C. and its final boiling point in the range 290 to 400° C. Its kinematic viscosity at 40° C. (ASTM D-445) might suitably be from 1.5 to 4.5 mm$^2$/s (centistokes). However, a diesel fuel composition according to the present invention may contain fuel components with properties outside of these ranges, since the properties of an overall blend may differ, often significantly, from those of its individual constituents.

A petroleum derived gas oil may be obtained by refining and optionally (hydro)processing a crude petroleum source. It may be a single gas oil stream obtained from such a refinery process or a blend of several gas oil fractions obtained in the refinery process via different processing routes. Examples of such gas oil fractions are straight run gas oil, vacuum gas oil, gas oil as obtained in a thermal cracking process, light and heavy cycle oils as obtained in a fluid catalytic cracking unit and gas oil as obtained from a hydrocracker unit. Optionally, a petroleum derived gas oil may comprise some petroleum derived kerosene fraction.

Such gas oils may be processed in a hydrodesulphurisation (HDS) unit so as to reduce their sulphur content to a level suitable for inclusion in a diesel fuel composition.

The base fuel used in a composition according to the present invention may itself be or contain a Fischer-Tropsch derived fuel component, in particular a Fischer-Tropsch derived gas oil. Such fuels are known and in use in automotive diesel and other middle distillate fuel compositions. They are, or are prepared from, the synthesis products of a Fischer-Tropsch condensation reaction, as described above.

More suitably, however, the middle distillate base fuel is a non-Fischer-Tropsch derived, for example petroleum derived, base fuel.

In a fuel composition according to the present invention, the base fuel may itself comprise a mixture of two or more middle distillates, in particular diesel, fuel components of the types described above. It may be or contain a so-called "biodiesel" fuel component such as a vegetable oil or vegetable oil derivative (e.g. a fatty acid ester, in particular a fatty acid methyl ester) or another oxygenate such as an acid, ketone or ester. Such components need not necessarily be bio-derived.

The fuel composition will suitably contain a major proportion of the middle distillate base fuel. A "major proportion" means typically 80 wt % or greater, more suitably 90 or 95 wt % or greater, most preferably 98 or 99 or 99.5 wt % or greater.

The concentration of the Fischer-Tropsch derived paraffinic heavy base oil component (b), in a fuel composition according to the present invention, may be 0.01 wt % or greater, or 0.05 wt % or greater, for example 0.1 or 0.2 or 0.5 or 1 or 1.5 wt % or greater. It may be 5 wt % or lower, for example 4 or 3 or 2 wt % or lower. In cases it may be 1 wt % or lower, or 0.5 wt % or lower. It may, for instance, be from 0.1 to 4 wt %, or from 0.5 to 3 wt %, or from 1 to 2.5 wt %, such as around 2 wt %. In some fuel compositions it may be from 0.1 to 1 wt %, or from 0.1 to 0.5 wt %.

All concentrations, unless otherwise stated, are quoted as percentages of the overall fuel composition.

The heavy base oil may be used at a concentration, between 0.01 and 10 wt % based on the resultant fuel composition, at which the CFPP of the composition reaches a minimum. This minimum may appear at a different concentration for different Fischer-Tropsch derived heavy base oils and/or middle distillate base fuels. It may for example be between 0.1 and 10 wt % based on the overall fuel composition, or between 0.5 and 5 wt %, or between 1 and 3 wt %. The concentration at which the heavy base oil is used is preferably chosen so as to achieve a lower CFPP than that of the fuel composition prior to incorporation of the base oil.

The concentration of the Fischer-Tropsch derived heavy base oil will generally be chosen to ensure that the density, viscosity, cetane number, calorific value and/or other relevant properties of the overall fuel composition are within the desired ranges, for instance within commercial or regulatory specifications.

A fuel composition according to the present invention will preferably be, overall, a low or ultra low sulphur fuel composition, or a sulphur free fuel composition, for instance containing at most 500 ppmw, preferably no more than 350 ppmw, most preferably no more than 100 or 50 ppmw, or even 10 ppmw or less, of sulphur.

In particular where the fuel composition is an automotive diesel fuel composition, it will suitably comply with applicable current standard specification(s) such as for example EN 590:99 (for Europe) or ASTM D-975-05 (for the USA). By way of example, the fuel composition may have a density from 0.82 to 0.845 g/cm$^3$ at 15° C.; a final boiling point (ASTM D86) of 360° C. or less; a cetane number (ASTM D613) of 51 or greater; a kinematic viscosity (ASTM D445) from 2 to 4.5 mm$^2$/s (centistokes) at 40° C.; a sulphur content (ASTM D2622) of 350 ppmw or less; and/or a total aromatics content (IP 391(mod)) of less than 11% m/m. Relevant specifications may however differ from country to country and from year to year and may depend on the intended use of the fuel composition.

A fuel composition according to the present invention—in particular when it is an automotive diesel fuel composition—may contain other components in addition to the middle distillate base fuel and the Fischer-Tropsch derived paraffinic heavy base oil. Such components will typically be present in fuel additives. Examples are detergents; lubricity enhancers; dehazers, e.g. alkoxylated phenol formaldehyde polymers; anti-foaming agents (e.g. polyether-modified polysiloxanes); ignition improvers (cetane improvers) (e.g. 2-ethylhexyl nitrate (EHN), cyclohexyl nitrate, di-tert-butyl peroxide and those disclosed in U.S. Pat. No. 4,208,190 at column 2, line 27 to column 3, line 21); anti-rust agents (e.g. a propane-1,2-diol semi-ester of tetrapropenyl succinic acid, or polyhydric alcohol esters of a succinic acid derivative, the succinic acid derivative having on at least one of its alpha-carbon atoms an unsubstituted or substituted aliphatic hydrocarbon group containing from 20 to 500 carbon atoms, e.g. the pentaerythritol diester of polyisobutylene-substituted succinic acid); corrosion inhibitors; reodorants; anti-wear additives; anti-oxidants (e.g. phenolics such as 2,6-di-tert-butylphenol, or phenylenediamines such as N,N'-di-sec-butyl-p-phenylenediamine); metal deactivators; static dissipator additives; combustion improvers; and mixtures thereof.

Detergent-containing diesel fuel additives are known and commercially available. Such additives may be added to diesel fuel compositions at levels intended to reduce, remove, or slow the build up of engine deposits. Examples of detergents suitable for use in fuel additives for the present purpose include polyolefin substituted succinimides or succinamides of polyamines, for instance polyisobutylene succinimides or polyisobutylene amine succinamides, aliphatic amines, Mannich bases or amines and polyolefin (e.g. polyisobutylene) maleic anhydrides. Succinimide dispersant additives are described for example in GB-A-960493, EP-A-0147240, EP-A-0482253, EP-A-0613938, EP-A-0557516 and WO-A-98/42808. Particularly preferred are polyolefin substituted succinimides such as polyisobutylene succinimides.

A middle distillate fuel composition, in particular a diesel fuel composition, preferably includes a lubricity enhancer, in particular when the fuel composition has a low (e.g. 500 ppmw or less) sulphur content. A lubricity enhancer is conveniently used at a concentration of less than 1000 ppmw, preferably from 50 to 1000 or from 100 to 1000 ppmw, more preferably from 50 to 500 ppmw. Suitable commercially available lubricity enhancers include ester- and acid-based additives. Other lubricity enhancers are described in the patent literature, in particular in connection with their use in low sulphur content diesel fuels, for example in:

the paper by Danping Wei and H. A. Spikes, "*The Lubricity of Diesel Fuels*", Wear, III (1986) 217-235;

WO-A-95/33805—cold flow improvers to enhance lubricity of low sulphur fuels;

WO-A-94/17160—certain esters of a carboxylic acid and an alcohol wherein the acid has from 2 to 50 carbon atoms and the alcohol has 1 or more carbon atoms, particularly glycerol monooleate and di-isodecyl adipate, as fuel additives for wear reduction in a diesel engine injection system;

U.S. Pat. No. 5,490,864—certain dithiophosphoric diester-dialcohols as anti-wear lubricity additives for low sulphur diesel fuels; and WO-A-98/01516—certain alkyl aromatic compounds having at least one carboxyl group attached to their aromatic nuclei, to confer anti-wear lubricity effects particularly in low sulphur diesel fuels.

It may also be preferred for the fuel composition to contain an anti-foaming agent, more preferably in combination with an anti-rust agent and/or a corrosion inhibitor and/or a lubricity enhancing additive.

Unless otherwise stated, the concentration of each such additional component in the fuel composition is preferably up to 10000 ppmw, more preferably in the range from 0.1 to 1000 ppmw, advantageously from 0.1 to 300 ppmw, such as from 0.1 to 150 ppmw. (All additive concentrations quoted in this specification refer, unless otherwise stated, to active matter concentrations by mass.)

The concentration of any dehazer in the fuel composition will preferably be in the range from 0.1 to 20 ppmw, more preferably from 1 to 15 ppmw, still more preferably from 1 to 10 ppmw, advantageously from 1 to 5 ppmw. The concentration of any ignition improver present will preferably be 2600 ppmw or less, more preferably 2000 ppmw or less, conveniently from 300 to 1500 ppmw.

If desired one or more additive components, such as those listed above, may be co-mixed—preferably together with suitable diluent(s)—in an additive concentrate, and the additive concentrate may then be dispersed into the base fuel, or into the base fuel/heavy base oil blend, in order to prepare a fuel composition according to the present invention.

A diesel fuel additive may for example contain a detergent, optionally together with other components as described above, and a diesel fuel-compatible diluent, for instance a non-polar hydrocarbon solvent such as toluene, xylene, white spirits and those sold by Shell companies under the trade mark "SHELLSOL", and/or a polar solvent such as an ester or in particular an alcohol, e.g. hexanol, 2-ethylhexanol, decanol, isotridecanol and alcohol mixtures, most preferably 2-ethylhexanol. The Fischer-Tropsch derived paraffinic heavy base oil may, in accordance with the present invention, be incorporated into such an additive formulation.

The total additive content in the fuel composition may suitably be from 50 to 10000 ppmw, preferably below 5000 ppmw.

Additives may be added at various stages during the production of a fuel composition; those added at the refinery for example might be selected from anti-static agents, pipeline drag reducers, flow improvers (e.g. ethylene/vinyl acetate copolymers or acrylate/maleic anhydride copolymers), lubricity enhancers, anti-oxidants and wax anti-settling agents. When carrying out the present invention, a base fuel may already contain such refinery additives. Other additives may be added downstream of the refinery.

Where a fuel composition according to the present invention contains one or more cold flow additives, for example flow improvers and/or wax anti-settling agents, such additives may be present at reduced concentrations due to the presence of the Fischer-Tropsch derived paraffinic heavy base oil, as described below in connection with the fourth aspect of the present invention.

According to a second aspect, the present invention provides the use of a Fischer-Tropsch derived paraffinic heavy base oil in a middle distillate fuel composition, for the purpose of improving the cold flow properties and/or the low temperature performance of the composition.

According to a third aspect, the present invention provides a method for formulating a middle distillate fuel composition containing a middle distillate base fuel, optionally with other fuel components, the method comprising (i) measuring the cold flow properties of the base fuel and (ii) incorporating into the base fuel a Fischer-Tropsch derived paraffinic heavy base oil, in an amount sufficient to improve the cold flow properties of the mixture.

The cold flow properties of a fuel composition can suitably be assessed by measuring its cold filter plugging point (CFPP), preferably using the standard test method IP 309 or an analogous technique. The CFPP of a fuel indicates the temperature at and below which wax in the fuel will cause severe restrictions to flow through a filter screen, and in the case of automotive diesel fuels, for example, can correlate with vehicle operability at lower temperatures. A reduction in CFPP will correspond to an improvement in cold flow properties, other things being equal. Improved cold flow properties in turn increase the range of climatic conditions or seasons in which a fuel can efficiently be used.

Cold flow properties may be assessed in any other suitable manner, for example using the Aral short sediment test (EN 23015), and/or by assessing the low temperature performance of a diesel engine, vehicle or other system running on the fuel composition. The temperature at which such performance is measured may depend on the climate in which the fuel composition is intended to be used—in Greece, for example, "low temperature performance" may be assessed at −5° C., whereas in Finland low temperature performance may be required at −30° C.; in hotter countries where fuels are generally used at higher ambient temperatures, "low temperature" performance may need to be assessed at only 5 to 10 degrees below the ideal ambient temperature. In general, an improvement in cold flow properties and/or low temperature performance may be manifested by a reduction in the minimum temperature at which a system running on the fuel composition can perform to a given standard.

An improvement in cold flow properties may be manifested by a reduction in, ideally suppression of, so-called "hesitation" effects which can occur in a CFPP test at temperatures higher than the CFPP value of a fuel. "Hesitation" may be understood as an at least partial obstruction of the CFPP test filter occurring at a temperature higher than the CFPP. Such an obstruction will be manifested—in a CFPP machine modified to allow such measurements—by an increased filtration time, albeit at a level below 60 seconds. If severe enough, hesitation causes the test to terminate early and the CFPP value to be recorded as the higher temperature—thus when hesitation occurs to a great enough extent, it is not recognised as hesitation but simply as a higher CFPP. References in this specification to CFPP values may generally be taken to include values which take account of—i.e. are raised as a result of—such hesitation effects.

A reduction in hesitation effects may be manifested by complete elimination of a hesitation effect which would be observed when measuring the CFPP of the fuel composition without the Fischer-Tropsch derived heavy base oil present; and/or by a reduction in severity of such a hesitation effect (e.g. severe hesitation becomes only mild hesitation); and/or by a lowering of the temperature at which such a hesitation effect occurs. Since hesitation effects can cause variability in the measured CFPP of a fuel composition, in severe test machines triggering an increase in the recorded value, such a reduction may be beneficial because it can allow the CFPP of the composition to be more reliably and accurately measured, in turn allowing the composition to be more readily tailored to meet, and proven to meet, specifications such as industry or regulatory standards.

The cold flow properties of a fuel composition may additionally or alternatively be assessed by measuring its pour point, which is the lowest temperature at which movement of the composition can be observed. A reduction in pour point indicates an improvement in cold flow properties. It can suitably be measured using the standard test method ASTM D-5950 or an analogous technique.

In the context of yet other aspects of the present invention, "improving" the cold flow properties of the fuel composition embraces any degree of improvement compared to the performance of the composition before the Fischer-Tropsch derived paraffinic heavy base oil is incorporated. This may, for example, involve adjusting the cold flow properties of the composition, by means of the heavy base oil, in order to meet a desired target, for instance a desired target CFPP value.

By using the present invention, the CFPP of the composition may be reduced by at least 1° C. compared to its value prior to addition of the heavy base oil, preferably by at least 2° C., more preferably by at least 3° C. and most preferably by at least 4 or 5 or in cases 6 or 7 or 8° C.

By using the invention, the CFPP of the composition may be reduced by at least 0.5% of its value (expressed in Kelvin) prior to addition of the heavy base oil, more preferably by at least 1% and most preferably by at least 1.2 or 1.5 or 2 or 2.5 or even 2.8 or 3%.

A fuel composition prepared according to the present invention may have a CFPP of −10° C. or lower, preferably −12 or −15 or −21° C. or lower.

According to the second and third aspects of the present invention, the Fischer-Tropsch derived paraffinic heavy base oil may be used for the dual purposes of improving the cold flow properties of the fuel composition and at the same time improving another property of the composition, for example increasing its cetane number or calorific value or viscosity, improving its lubricity, or changing the nature or level of emissions it causes during use in a fuel consuming system, in particular an automotive diesel engine. The heavy base oil may be used for the purpose of improving the acceleration and/or other measures of engine performance in an engine running on the fuel composition.

A middle distillate fuel composition, particularly a "winter" fuel composition which is intended for use in colder climates and/or at colder times of the year, will often include one or more cold flow additives so as to improve its performance and properties at lower temperatures. Known cold flow additives include middle distillate flow improvers and wax anti-settling additives. Since the present invention may be used to improve the cold flow properties of a fuel composition, it may also make possible the use of lower levels of such cold flow additives, and/or of other flow improver additives. In other words, inclusion of the Fischer-Tropsch derived paraffinic heavy base oil potentially enables lower levels of cold flow and/or flow improver additives to be used in order to achieve a desired target level of cold flow performance from the overall composition.

Accordingly, in another aspect of the present invention provides the use of a Fischer-Tropsch derived paraffinic heavy base oil in a middle distillate fuel composition, for the purpose of reducing the concentration of a cold flow or flow improver additive in the composition.

In this text, the term "reducing" embraces any degree of reduction—for instance 1% or more of the original cold flow additive concentration, preferably 2 or 5 or 10 or 20% or more, or in cases reduction to zero. The reduction may be as compared to the concentration of the relevant additive which would otherwise have been incorporated into the fuel composition in order to achieve the properties and performance required or desired of it in the context of its intended use. This may, for instance, be the concentration of the additive which was present in the fuel composition prior to the realisation that a Fischer-Tropsch derived paraffinic heavy base oil could be used in the way provided by the present invention, or which was present in an otherwise analogous fuel composition intended (e.g. marketed) for use in an analogous context, prior to adding a Fischer-Tropsch derived paraffinic heavy base oil to it.

In the case for example of a diesel fuel composition intended for use in an automotive engine, a certain level of cold flow performance may be desirable in order for the composition to meet current fuel specifications, and/or to safeguard engine performance, and/or to satisfy consumer demand, in particular in colder climates or seasons. According to the present invention, such standards may still be achievable even with reduced levels of cold flow additives, due to the inclusion of the Fischer-Tropsch derived paraffinic heavy base oil.

A cold flow additive may be defined as any material capable of improving the cold flow properties of the composition, as described above. A flow improver additive is a material capable of improving the ability or tendency of the composition to flow at any given temperature. A cold flow additive may for example be a middle distillate flow improver (MDFI) or a wax anti-settling additive (WASA) or a mixture thereof.

MDFIs may for example comprise vinyl ester-containing compounds such as vinyl acetate-containing compounds, in particular polymers. Copolymers of alkenes (for instance ethylene, propylene or styrene, more typically ethylene) and unsaturated esters (for instance vinyl carboxylates, typically vinyl acetate) are for instance known for use as MDFIs.

Other known cold flow additives (also referred to as cold flow improvers) include comb polymers (polymers having a plurality of hydrocarbyl group-containing branches pendant from a polymer backbone), polar nitrogen compounds including amides, amines and amine salts, hydrocarbon polymers and linear polyoxyalkylenes. Examples of such compounds are given in WO-A-95/33805, the disclosures of which are incorporated herein in their entirety, at pages 3 to 16 and in the examples.

Yet further examples of compounds useable as cold flow additives include those described in WO-A-95/23200, the disclosures of which are incorporated herein in their entirety. These include the comb polymers defined at pages 4 to 7 thereof, in particular those consisting of copolymers of vinyl acetate and alkyl-fumarate esters; and the additional low temperature flow improvers described at pages 8 to 19 thereof, such as linear oxygen-containing compounds, including alcohol alkoxylates (e.g. ethoxylates, propoxylates or butoxylates) and other esters and ethers; ethylene copolymers of unsaturated esters such as vinyl acetate or vinyl hexanoate; polar nitrogen containing materials such as phthalic acid amide or hydrogenated amines (in particular hydrogenated fatty acid amines); hydrocarbon polymers (in particular ethylene copolymers with other alpha-olefins such as propylene or styrene); sulphur carboxy compounds such as sulphonate salts of long chain amines, amine sulphones or amine carboxamides; and hydrocarbylated aromatics.

Such cold flow additives are conventionally included in diesel fuel compositions so as to improve their performance at lower temperatures, and thus to improve the low temperature operability of systems (typically vehicles) running on the compositions.

The (active matter) concentration of cold flow additive in a fuel composition prepared according to the invention may be up to 1000 ppmw, preferably up to 500 ppmw, more preferably up to 400 or 300 or 200 or even 150 or 100 ppmw. Its (active matter) concentration will suitably be at least 20 ppmw; it may be at least 30 or 50 ppm, or at least 100 ppmw.

In the context of the second and fourth aspects of the present invention, "use" of a Fischer-Tropsch derived paraffinic heavy base oil in a fuel composition means incorporating the base oil into the composition, typically as a blend (i.e. a physical mixture) with one or more other fuel components (in particular the middle distillate base fuel) and optionally with one or more fuel additives. The Fischer-Tropsch derived paraffinic heavy base oil is conveniently incorporated before the composition is introduced into an internal combustion engine or other system which is to be run on the composition. Instead or in addition, the use may involve running a fuel consuming system, such as an engine, on the fuel composition containing the Fischer-Tropsch derived paraffinic heavy base oil, typically by introducing the composition into a combustion chamber of the system.

"Use" of a Fischer-Tropsch derived paraffinic heavy base oil may also embrace supplying such a base oil together with instructions for its use in a middle distillate fuel composition to achieve the purpose(s) of the second and/or fourth aspects of the present invention, for instance to achieve a desired target level of cold flow performance (e.g. a desired target CFPP value) and/or to reduce the concentration of a cold flow additive in the composition. The heavy base oil may itself be supplied as a component of a formulation which is suitable for and/or intended for use as a fuel additive, in which case the heavy base oil may be included in such a formulation for the purpose of influencing its effects on the cold flow properties of a middle distillate fuel composition.

Thus, the Fischer-Tropsch derived paraffinic heavy base oil may be incorporated into an additive formulation or package along with one or more other fuel additives. More typically, however, it will be dosed directly into a middle distillate fuel composition.

There is provided a process for the preparation of a middle distillate fuel composition, such as a composition according to the first aspect, which process involves blending a middle distillate (for example diesel) base fuel with a Fischer-Tropsch derived paraffinic heavy base oil as defined above. The blending may be carried out for one or more of the purposes described above in connection with the second to the fourth aspects of the present invention, in particular with respect to the cold flow properties of the resultant fuel composition.

Another aspect provides a method of operating a fuel consuming system, which method involves introducing into the system a fuel composition according to the first aspect of the present invention, and/or a fuel composition prepared in accordance with any one of the aspects described above. Again the fuel composition is preferably introduced for one or more of the purposes described in connection with the above aspects of the present invention. Thus, the system is preferably operated with the fuel composition for the purpose of improving the low temperature performance of the system.

The system may in particular be an internal combustion engine, and/or a vehicle which is driven by an internal combustion engine, in which case the method involves introducing the relevant fuel composition into a combustion chamber of the engine. The engine is preferably a compression ignition (diesel) engine. Such a diesel engine may be of the direct injection type, for example of the rotary pump, in-line pump, unit pump, electronic unit injector or common rail type, or of the indirect injection type. It may be a heavy or a light duty diesel engine.

Throughout the description and claims of this specification, the words "comprise" and "contain" and variations of the words, for example "comprising" and "comprises", mean "including but not limited to", and do not exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Preferred features of each aspect of the present invention may be as described in connection with any of the other aspects.

Other features of the present invention will become apparent from the following examples. Generally speaking, the present invention extends to any novel one, or any novel combination, of the features disclosed in this specification (including any accompanying claims and drawings). Thus features, integers, characteristics, compounds, chemical moieties or groups described in conjunction with a particular aspect, embodiment or example of the present invention are to be understood to be applicable to any other aspect, embodiment or example described herein unless incompatible therewith.

Moreover unless stated otherwise, any feature disclosed herein may be replaced by an alternative feature serving the same or a similar purpose.

The following examples illustrate the properties of fuel compositions in accordance with the present invention, and assess the effects of Fischer-Tropsch derived paraffinic heavy base oils on the cold flow performance of middle distillate, in this case diesel, fuel compositions.

EXAMPLE 1

A Fischer-Tropsch derived heavy base oil, BO-1, was blended in a range of proportions with a petroleum derived low sulphur diesel base fuel F1 (ex. Shell). The effect of the different base oil concentrations on the cold filter plugging points (CFPPs) of the blends was measured using the standard test method IP 309. For each blend, CFPPs were measured in duplicate, using two out of three different machines.

The heavy base oil was obtained by a process such as is described in Example 6 below. It had a kinematic viscosity of 19.00 $mm^2/s$ (centistokes) at 100° C. (ASTM D-445), a pour point (ASTM D-5950) of −30° C. and a density at 15° C. (IP 365/97) of 834.1 $kg/m^3$. It consisted almost entirely of iso-paraffins, with a high molecular weight and with an epsilon methylene carbon content of 16%. The ratio of the % epsilon carbon content to the % carbon in iso-propyl groups was 6.98.

The properties of the diesel base fuel F1 are shown in Table 1 below, along with those of the base fuel F2 used in Examples 3 to 5.

TABLE 1

| | Test method | F1 | F2 |
|---|---|---|---|
| Fuel property | | | |
| Density @ 15° C. ($kg/m^3$) | IP 365 | 0.8325 | 0.7846 |
| CFPP (° C.) | IP 309 | −8 | −1 |
| Cloud point (° C.) | ASTM D-5773 | −8 | −0.5 |
| Kinematic viscosity @ 40° C. ($mm^2/s$ (cSt)) | IP 71 | 2.81 | 3.497 |
| Cetane number (IQT) | IP 498 | 54.6 | 82.8 |
| Distillation (° C.): | IP 123/ASTM D-86 | | |
| IBP | | 163.5 | 219.5 |
| 10% recovered | | 204.1 | 245.9 |
| 50% recovered | | 277.8 | 295.2 |
| 90% recovered | | 327.8 | 342.1 |
| 95% recovered | | 342.1 | 353 |
| FBP | | 350.5 | 358.2 |
| % v at 250° C. | | 29.5 | 13.7 |
| % v at 350° C. | | 96.8 | 93.8 |
| Composition: | | | |
| Hydrocarbons: | IP 156/ASTM D-1319 | | |
| C:H ratio | | 85.8:3.4 | 85:15 |
| HPLC aromatics (wt %) | IP 391 (mod) | 22.8 | — |
| Total sulphur (mg/kg) | ASTM D-2622 | 46 | <5 |

Despite the base oil having a residual haze, it was unexpectedly found possible to achieve homogeneous mixing in all the base fuel/base oil blends tested. Only the blend containing 10 wt % of the heavy base oil appeared slightly hazy; the rest appeared clear and bright at room temperature, which generally indicates a negative cloud point.

Moreover, the CFPP of the base fuel was found to be reduced by the heavy base oil, as shown by the CFPP results in Table 2 below.

TABLE 2

| Base fuel F1 (wt %) | Heavy base oil BO-1 (wt %) | CFPP #1 (° C.) | CFPP #2 (° C.) | CFPP #3 (° C.) | Mean CFPP (° C.) |
|---|---|---|---|---|---|
| 100.00 | 0.00 | −9 | −8 | N/A | −8.5 |
| 99.00 | 1.00 | N/A | −13 | −13 | −13 |
| 98.50 | 1.50 | −16 | −16 | N/A | −16 |
| 98.00 | 2.00 | −17 | N/A | −16 | −16.5 |
| 97.00 | 3.00 | N/A | −13 | −14 | −13.5 |
| 96.00 | 4.00 | −14 | −13 | N/A | −13.5 |

TABLE 2-continued

| Base fuel F1 (wt %) | Heavy base oil BO-1 (wt %) | CFPP #1 (° C.) | CFPP #2 (° C.) | CFPP #3 (° C.) | Mean CFPP (° C.) |
|---|---|---|---|---|---|
| 95.00 | 5.00 | −15 | −15 | N/A | −15 |
| 90.00 | 10.00 | −12 | −12 | N/A | −12 |

The reduction in CFPP, due to inclusion of the Fischer-Tropsch derived heavy base oil, appears to be non-linear with increasing base oil concentration. The greatest reduction was seen at base oil concentrations around 1 and 2 wt %, with a minimum CFPP value recorded for the blend containing 2 wt % of the base oil. Even at 10 wt % base oil, however, the blend had a significantly lower CFPP than that recorded for the diesel base fuel alone. These reductions in CFPP in turn demonstrate an improvement in the cold flow properties of the fuels.

The data are surprising in that, although the base oil BO-1 has a relatively low pour point, one would generally expect that on blending it with a diesel base fuel, its residual haze would re-precipitate and cause an overall deterioration in CFPP. Based purely on linear blending rules, one would not, therefore, have expected such an improvement in CFPP values due to inclusion of the exemplified proportions of the heavy base oil.

EXAMPLE 2

Example 1 was repeated, but using lighter Fischer-Tropsch derived base oils, one (BO-2) having a kinematic viscosity of 2.39 $mm^2/s$ (centistokes) at 100° C. and a pour point of −51° C. and the other (BO-3) a kinematic viscosity of 4.03 $mm^2/s$ (centistokes) at 100° C. and a pour point of −30° C. Again these base oils had been prepared using a process generally similar to that of Example 6, and both had been dewaxed in the same manner and to the same extent as the heavy base oil BO-1. Neither of them, however, caused significant modification of the CFPP of the diesel base fuel F1. This indicates that the synergy observed in Example 1 may be unique to the higher molecular weight Fischer-Tropsch bottoms-derived base oils.

EXAMPLE 3

Example 1 was repeated but using as the base fuel a Fischer-Tropsch derived gas oil F2, which had the properties shown in Table 1 above.

F2 was blended, as in Example 1, with different concentrations of the Fischer-Tropsch derived heavy base oil BO-1. The blends containing 1 and 2 wt % of the heavy base oil were both clear and bright in appearance, as was the base fuel F2 alone. The blend containing 3 wt % of the heavy base oil was very slightly hazy; further blends prepared using 4 and 5 wt % of the heavy base oil were also hazy or slightly hazy.

The CFPPs of the different blends are shown in Table 3.

TABLE 3

| Base fuel F2 (wt %) | Heavy base oil BO-1 (wt %) | CFPP #1 (° C.) | CFPP #2 (° C.) | CFPP #3 (° C.) | Mean CFPP (° C.) |
|---|---|---|---|---|---|
| 100.00 | 0.00 | −2 | −1 | N/A | −1.5 |
| 99.00 | 1.00 | N/A | −2 | −1 | −1.5 |

TABLE 3-continued

| Base fuel F2 (wt %) | Heavy base oil BO-1 (wt %) | CFPP #1 (° C.) | CFPP #2 (° C.) | CFPP #3 (° C.) | Mean CFPP (° C.) |
|---|---|---|---|---|---|
| 98.00 | 2.00 | −3 | N/A | −4 | −3.5 |
| 97.00 | 3.00 | −5 | −5 | N/A | −5 |

Again Table 3 shows the effect of the heavy base oil in reducing the CFPP of the overall fuel composition, although to a lesser extent than when using the petroleum derived base fuel F1 of Example 1.

EXAMPLE 4

Examples 1 and 3 were repeated but blending the base fuels F1 and F2 with a fourth Fischer-Tropsch derived heavy base oil BO-4. BO-4 had been prepared using a process broadly similar to that of Example 6, but had been subjected during its production to a significantly less severe dewaxing process than BO-1. Its pour point (ASTM D-5950) was only −6° C. and its kinematic viscosity at 100° C. (ASTM D-445) was 25.22 $mm^2/s$ (cSt). Its density at 15° C. (IP 365/97) was 840.2 $kg/m^3$. It contained a high proportion (c. 90% w/w) of iso-paraffins, and had an initial boiling point (ASTM D-2887) of 448.0° C. and a 95% recovery boiling point of 750.0° C. Its viscosity index (ASTM D-2270) was 140.

Of the F1 blends, those containing 1 and 1.5 wt % of BO-4 were clear and bright in appearance, as was F1 itself. The blend containing 2 wt % of BO-4 was very slightly hazy, and that containing 5 wt % of BO-4 was hazy in appearance.

Of the F2 blends, that containing 1 wt % of BO-4 appeared clear and bright, as did F2 itself. The blend containing 1.5 wt % of BO-4 was very slightly hazy, that containing 2 wt % of BO-4 was slightly hazy, and that containing 5 wt % of BO-4 was hazy in appearance.

The CFPP results for the F1 blends are shown in Table 4 below, those for the F2 blends in Table 5.

TABLE 4

| Base fuel F1 (wt %) | Heavy base oil BO-4 (wt %) | CFPP #1 (° C.) | CFPP #2 (° C.) | CFPP #3 (° C.) | Mean CFPP (° C.) |
|---|---|---|---|---|---|
| 100.00 | 0.00 | −9 | −8 | N/A | −8.5 |
| 99.00 | 1.00 | −21 | −22 | N/A | −21.5 |
| 98.50 | 1.50 | −21 | −14 | −20 | −18.3 |
| 98.00 | 2.00 | N/A | −14 | −14 | −14 |
| 95.00 | 5.00 | −15 | N/A | −13 | −14 |

TABLE 5

| Base fuel F2 (wt %) | Heavy base oil BO-4 (wt %) | CFPP #1 (° C.) | CFPP #2 (° C.) | CFPP #3 (° C.) | Mean CFPP (° C.) |
|---|---|---|---|---|---|
| 100.00 | 0.00 | −2 | −1 | N/A | −1.5 |
| 99.00 | 1.00 | −3 | −4 | N/A | −3.5 |
| 98.50 | 1.50 | −4 | −6 | N/A | −5 |
| 98.00 | 2.00 | −7 | N/A | −6 | −6.5 |
| 95.00 | 5.00 | N/A | −7 | −5 | −6 |

The Fischer-Tropsch derived heavy base oil BO-4, like BO-1, thus appears to depress the CFPP of both base fuels in the concentration ranges tested. Its effect is particularly marked for the petroleum derived mineral base fuel F1.

The above results illustrate the utility of the present invention in formulating improved diesel fuel compositions. The present invention may be used to improve the low temperature performance of a diesel fuel composition and/or to reduce the level of cold flow additives required in it. In addition, since Fischer-Tropsch derived fuel components are known to act as cetane improvers, the cetane number of the composition can be simultaneously increased, and greater fuel economy can be obtained through the improved upper ring pack lubrication afforded by inclusion of the base oil, which will act inherently as a lubricating oil.

EXAMPLE 5

Example 4 was repeated, but blending the base fuels F1 and F2 with a poly alpha-olefin PAO-1. Poly alpha-olefins (PAOs) are also known for use as fuel lubricants, and like the Fischer-Tropsch derived heavy base oils, are also largely iso-paraffinic in character and contain extremely high molecular weight constituents. They might, therefore, be expected to have a similar effect to the Fischer-Tropsch derived heavy base oils on the cold flow properties of a middle distillate fuel composition.

PAO-1 was sourced from Chevron Phillips LLC. It had a pour point of −39° C. and a kinematic viscosity at 100° C. of 23.55 $mm^2/s$ (centistokes).

The CFPP results for the F1 blends are shown in Table 6 below, those for the F2 blends in Table 7.

TABLE 6

| Base fuel F1 (wt %) | PAO-1 (wt %) | CFPP #1 (° C.) | CFPP #2 (° C.) | CFPP #3 (° C.) | Mean CFPP (° C.) |
|---|---|---|---|---|---|
| 100.00 | 0.00 | −9 | −8 | N/A | −8.5 |
| 99.00 | 1.00 | −10 | −9 | N/A | −9.5 |
| 98.50 | 1.50 | N/A | −9 | −8 | −8.5 |
| 98.00 | 2.00 | −8 | N/A | −9 | −8.5 |
| 95.00 | 5.00 | −10 | −8 | N/A | −9 |

TABLE 7

| Base fuel F2 (wt %) | PAO-1 (wt %) | CFPP #1 (° C.) | CFPP #2 (° C.) | CFPP #3 (° C.) | Mean CFPP (° C.) |
|---|---|---|---|---|---|
| 100.00 | 0.00 | −2 | −1 | N/A | −1.5 |
| 99.00 | 1.00 | N/A | −1 | −2 | −1.5 |
| 98.50 | 1.50 | −2 | −1 | N/A | −1.5 |
| 98.00 | 2.00 | N/A | −2 | −1 | −1.5 |
| 95.00 | 5.00 | −2 | −2 | N/A | −2 |

All blends were clear and bright in appearance, apart from those containing 2 wt % PAO-1 in the petroleum derived base fuel F1 (very slightly hazy), 5 wt % PAO-1 in F1 (hazy), 1.5 wt % PAO-1 in the Fischer-Tropsch derived base fuel F2 (very slightly hazy), 2 wt % PAO-1 in F2 (slightly hazy) and 5 wt % PAO-1 in F2 (hazy).

The data in Tables 6 and 7 show that inclusion of a poly alpha-olefin does not yield the beneficial effects found when, in accordance with the present invention, a middle distillate base fuel is blended with a Fischer-Tropsch derived paraffinic heavy base oil. This further confirms the surprising and selective nature of the present invention.

EXAMPLE 6

Preparation of Fischer-Tropsch Derived Heavy Base Oils

Fischer-Tropsch derived paraffinic heavy base oils, of use in fuel compositions according to the present invention, were prepared using the following methods.

a) Preparation of the Dewaxing Catalyst

MTW Type zeolite crystallites were prepared as described in "Verified synthesis of zeolitic materials", *Micropores and Mesopores Materials*, volume 22 (1998), pages 644-645, using tetra ethyl ammonium bromide as the template. The scanning electron microscope (SEM) visually observed particle size showed ZSM-12 particles of between 1 and 10 μm. The average crystallite size as determined by XRD line broadening technique was 0.05 μm. The crystallites thus obtained were extruded with a silica binder (10 wt % of zeolite, 90 wt % of silica binder). The extrudates were dried at 120° C. A solution of $(NH_4)_2SiF_6$ (45 ml of 0.019 N solution per gram of zeolite crystallites) was poured onto the extrudates. The mixture was then heated at 100° C. under reflux for 17 hours with gentle stirring above the extrudates. After filtration, the extrudates were washed twice with deionised water, dried for 2 hours at 120° C. and then calcined for 2 hours at 480° C.

The thus obtained extrudates were impregnated with an aqueous solution of platinum tetramine hydroxide followed by drying (2 hours at 120° C.) and calcining (2 hours at 300° C.). The catalyst was activated by reduction of the platinum under a hydrogen rate of 100 l/hr at a temperature of 350° C. for 2 hours. The resulting catalyst comprised 0.35 wt % platinum supported on the dealuminated, silica-bound MTW zeolite.

b) Sample 1

A partly isomerised Fischer-Tropsch derived wax having the properties listed in Table 8 below was used as the base oil precursor fraction.

TABLE 8

| | |
|---|---|
| Density at 70° C. (kg/l) | 0.7874 |
| T10 wt % (° C.) | 402 |
| T50 wt % (° C.) | 548 |
| T90 wt % (° C.) | 706 |
| Wax congealing point (° C.) | +71 |
| Kinematic viscosity at 100° C. ($mm^2/s$) | 16.53 |

This base oil precursor fraction was contacted with the above described dewaxing catalyst. The dewaxing conditions were 40 bar hydrogen pressure, a weight hourly space velocity (WHSV) of 1 kg/l/h, a temperature of 331° C. and a hydrogen gas feed rate of 500 Nl $H_2$/kg feed.

The thus dewaxed fraction was distilled into two base oil fractions having the properties listed in Table 9 below.

TABLE 9

| Fraction type | Light base oil | Heavy base oil |
|---|---|---|
| Boiling range of base oil product (° C.) | T(95%) = 481 | T(5%) = 472 |
| Yield based on feed to dewaxer (wt %) | 38.9 | 48.6 |
| Density at 20° C. (kg/l) | 0.798 | 0.8336 |

TABLE 9-continued

| Fraction type | Light base oil | Heavy base oil |
|---|---|---|
| Pour point (° C.) | −42 | −33 |
| Kinematic viscosity at 100° C. ($mm^2/s$) | 2.45 | 18.9 |

c) Sample 2

The procedure for preparing sample 2 started with a partly isomerised Fischer-Tropsch derived wax having the properties listed in Table 10 below.

TABLE 10

| | |
|---|---|
| T10 wt % (° C.) | 537 |
| T50 wt % (° C.) | 652 |
| T70 wt % (° C.) | 717 |
| T90 wt % (° C.) | >750 |
| Wax congealing point (° C.) | +106 |
| Kinematic viscosity at 150° C. ($mm^2/s$) | 15.07 |

This fraction was contacted with the above described dewaxing catalyst. The dewaxing conditions were 40 bar hydrogen, a WHSV of 1 kg/l/h, a temperature of 325° C. and a hydrogen gas feed rate of 500 Nl $H_2$/kg feed, i.e. less severe dewaxing conditions than those applied during the production of sample 1.

The dewaxed fraction was split by distillation of the effluents of the dewaxer into a light base oil fraction and a heavy residual fraction, the properties of which are listed in Table 11.

TABLE 11

| Fraction type | Light base oil | Heavy base oil |
|---|---|---|
| Boiling range of base oil product (° C.) | <470 | >470 |
| Yield based on heavy feed to dewaxer (wt %) | 36 | 60 |
| Density at 20° C. (kg/l) | <0.816 | 0.8388 |
| Pour point (° C.) | Not measured | −6 |
| Kinematic viscosity at 100° C. ($mm^2/s$) | <5 | 25.25 |

We claim:

1. A middle distillate fuel composition comprising (a) a middle distillate base fuel and (b) a Fischer-Tropsch derived paraffinic base oil component with a viscosity of at least 8 $mm^2/s$ at 100° C. and a pour point of −30° C. or lower.

2. The fuel composition of claim 1 wherein the middle distillate base fuel is a diesel base fuel.

3. The fuel composition of claim 1 wherein the base fuel is a non-Fischer-Tropsch derived base fuel.

4. The fuel composition of claim 1 wherein component (b) is a Fischer-Tropsch derived paraffinic heavy base oil.

5. The fuel composition of claim 4 wherein in the heavy base oil component (b), the ratio of the percentage of epsilon methylene carbon atoms to the percentage of isopropyl carbon atoms is 8.2 or below.

6. The fuel composition of claim 4 wherein the concentration of the heavy base oil component (b) is from 0.1 to 10 wt %.

7. A method for formulating a middle distillate fuel composition containing a middle distillate base fuel, optionally with other fuel components, the method comprising (i) measuring the cold flow properties of the base fuel and (ii) incorporating into the base fuel a Fischer-Tropsch derived paraffinic heavy base oil having a pour point of −30° C. or lower, in an amount effective to improve the cold flow properties of the mixture.

8. The method of claim 7 wherein said Fischer-Tropsch derived paraffinic heavy oil have the ratio of the percentage of epsilon methylene carbon atoms to the percentage of isopropyl carbon atoms of 8.2 or below.

9. A method of operating a fuel consuming system comprising introducing into the system a fuel composition of claim 1.

10. A method of operating a fuel consuming system comprising introducing into the system a fuel composition of claim 4.

11. A method of operating a fuel consuming system comprising introducing into the system a fuel composition of claim 5.

* * * * *